US007171876B2

(12) United States Patent
Chen

(10) Patent No.: US 7,171,876 B2
(45) Date of Patent: Feb. 6, 2007

(54) WRENCH COMBINATION

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/919,561

(22) Filed: Aug. 16, 2004

(65) Prior Publication Data

US 2005/0284268 A1 Dec. 29, 2005

(30) Foreign Application Priority Data

Jun. 25, 2004 (TW) ..... 93118450 A

(51) Int. Cl.
*B25B 23/16* (2006.01)

(52) U.S. Cl. ..... 81/177.8; 81/177.7; 411/154; 411/545; 403/146

(58) Field of Classification Search ..... 81/177.8, 81/177.9, 177.7; 411/154, 521, 545; 403/146
See application file for complete search history.

(56) References Cited

U.S. PATENT DOCUMENTS 713,255 A * 11/1902 Traut ..... 403/146
6,361,257 B1 * 3/2002 Grant ..... 411/154
2003/0015070 A1 * 1/2003 Chen ..... 81/177.9

* cited by examiner

*Primary Examiner*—D. S. Meilsin
(74) *Attorney, Agent, or Firm*—Alan D. Kamrath; Nikolai & Mersereau, P.A.

(57) ABSTRACT

A wrench combination includes a handle with an ear defining an aperture and an annular groove around the aperture. A wrench includes an annular head, an ear extending from the annular head and an annular gear put in the annular head. A washer is put in the annular groove defined in the ear of the handle. A washer is put in the annular groove defined in the ear of the wrench. Each washer includes an aperture, first and second pairs of contact locations at opposite positions of the aperture on a first side. Each washer also includes a central contact location intermediate each pair of contact locations and two lateral contact locations on an opposite second side. The central contact locations are located intermediate the two lateral contact locations. A joint includes a first pair of ears for sandwiching the ear of the handle and a second pair of ears for sandwiching the ear of the wrench. A first bolt is driven in the first pair of ears of the joints, the ear of the handle and the aperture of the washer put in the annular groove defined therein. A second bolt is driven in the second pair of ears of the joint, the ear of the wrench and the aperture of the washer portion in the annular groove defined therein.

18 Claims, 10 Drawing Sheets

WRENCH COMBINATION

BACKGROUND OF INVENTION

1. Field of Invention

The present invention relates to a wrench combination.

2. Related Prior Art

Referring to FIG. 10, a conventional wrench combination includes a first wrench 110 and a second wrench 120. The first wrench 110 includes a handle 130 and two ears 131 projecting from the handle 130. An aperture 134 is defined in one of the ears 131. A screw bore 135 is defined in the other one of the ears 131. The second wrench 120 includes an annular head 125 and an ear 122 extending from the head 125. An annular gear 121 is put rotationally in the annular head 125. The annular gear 121 can receive a bolt or nut. The ear 122 includes an aperture 124 defined therein and an annular groove 123 defined therein around the aperture 124. A washer 150, which defines an aperture 139, is put in the annular groove 123. The ear 122 is put between the ears 131. A bolt 140 is driven into the screw bore 135 through the apertures 124, 134 and 139. Thus, the second wrench 120 is pivotally connected with the first wrench 110. Referring to FIG. 11, the washer 150 includes a curved configuration. The washer 150 contacts the ear 122 at two locations and contacts one of the ears 131 at a single location. Therefore, the first wrench 110 tends to oscillate relative to the second wrench 120 when the wrench combination is in use.

The present invention is therefore intended to obviate or at least alleviate the problems encountered in the prior art.

SUMMARY OF THE INVENTION

A wrench combination includes a handle with an ear defining an aperture and an annular groove around the aperture. A wrench includes an annular head, an ear extending from the annular head and an annular gear put in the annular head. A washer is put in the annular groove defined in the ear of the handle. A washer is put in the annular groove defined in the ear of the wrench. Each washer includes an aperture, first and second pairs of contact locations at opposite positions of the aperture on a first side. Each washer also includes a central contact location intermediate each flair of contact locations and two lateral contact locations on an opposite second side. The central contact locations are located intermediate the two lateral contact locations. A joint includes a first pair of ears for sandwiching the ear of the handle and a second pair of ears for sandwiching the ear of the wrench. A first bolt is driven in the first pair of ears of the joint, the ear of the handle and the aperture of the washer put in the annular groove defined therein. A second bolt is driven in the second pair of ears of the joint, the ear of the wrench and the aperture of the washer portion in the annular groove defined therein.

The primary advantage of the wrench combination of the present invention is the washers prevent oscillation of the joint relative to the handle in use.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the drawings.

DETAILED DESCRIPTION OF EMBODIMENTS

Figure 1:
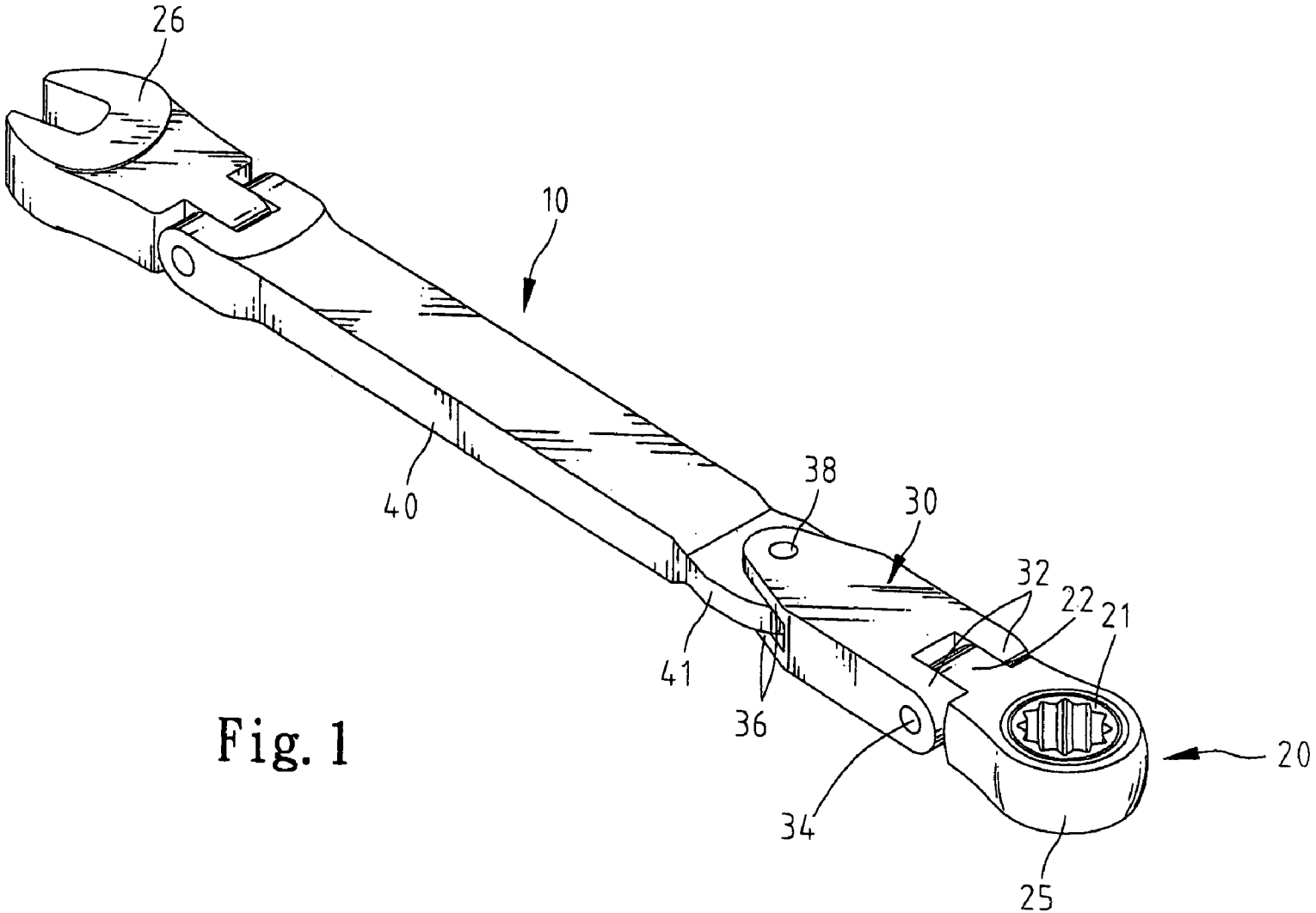
FIG. 1 is a perspective view of a wrench combination according to a first embodiment of the present invention.
Figure 2:
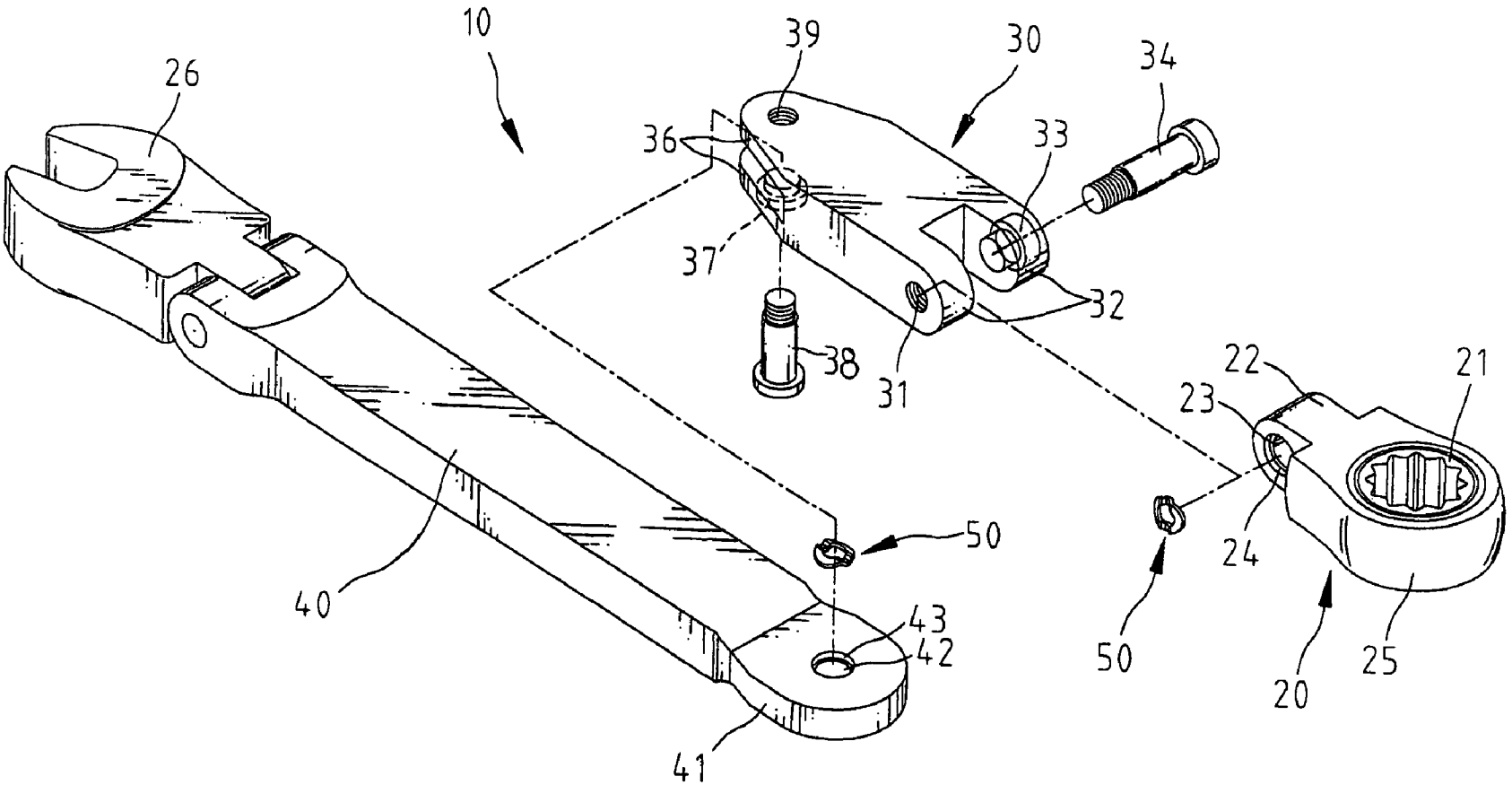
FIG. 2 is an exploded view of the wrench combination shown in FIG. 1.

Referring to FIGS. 1 and 2, according to a first embodiment of the present invention, a wrench combination 10 includes a handle 40, a first wrench 20, a joint 30 for connecting the first wrench 20 with the handle 40 and a second wrench 26 connected with the handle 40.

The handle 40 includes an ear 41 projecting from an end thereof. The ear 41 includes an aperture 42 defined therein and an annular groove 43 defined therein around the aperture 42.

The first wrench 20 includes an annular head 25 and an ear 22 extending from the annular head 25. Rotationally in the annular head 25 is an annular gear 21 for engagement with a bolt or nut. A selective one-way transmission (not shown) is provided between the annular head 25 and the annular gear 21. The selective one-way transmission will not be described in detail for being conventional. The ear 22 includes an aperture 23 defined therein and an annular groove 24 defined therein around the aperture 23.

The joint 30 includes two ears 36 formed at an end and two ears 32 formed at an opposite end. A countersink bore 37 is defined in one of the ears 36, and a screw bore 39 is defined in the other one of the ears 36. A countersink bore 33 is defined in one of the ears 32, and a screw bore 31 is defined in the other one of the ears 32. The ear 22 is put between the ears 32.

A washer 50, which defines an aperture 51, is put in the annular groove 43. The ear 41 is put between the ears 36. A bolt 38 is driven in the screw bore 39 through the countersink bore 37 and the apertures 42 and 51 in order to pivotally connect the joint 30 with the handle 40.

Figure 5:
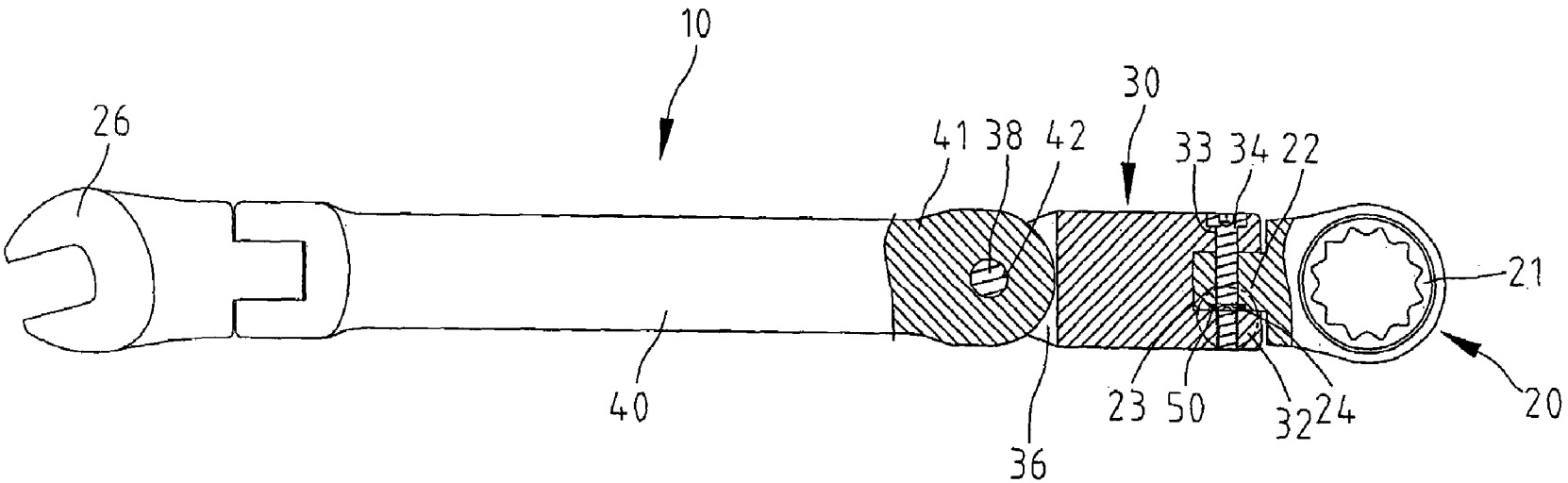
FIG. 5 is a partially cross-sectional view of the wrench combination shown in FIG. 1.
Figure 6:
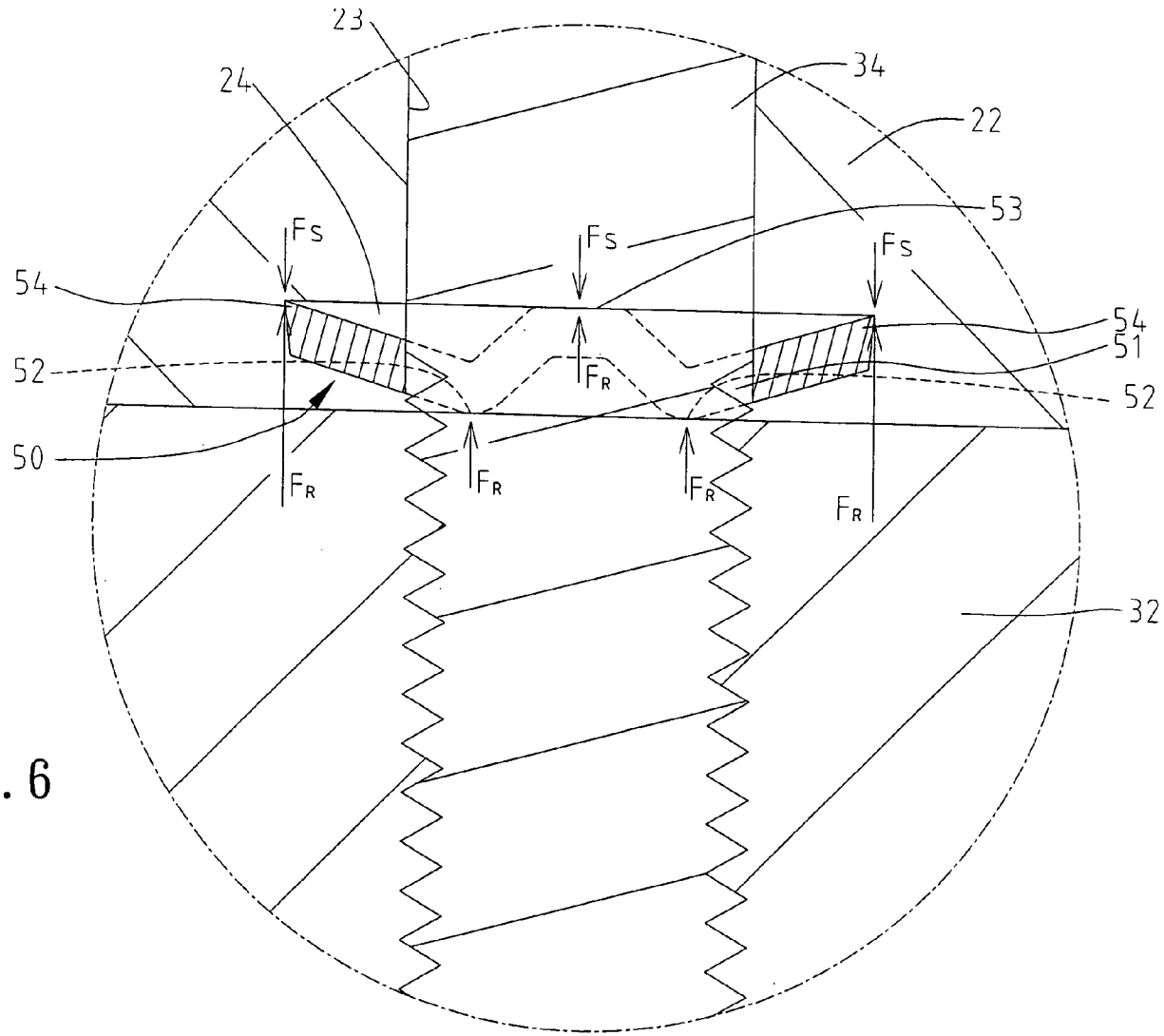
FIG. 6 is an enlarged cross-sectional partial view of the wrench combination shown in FIG. 5.

Referring to FIGS. 2, 5 and 6, a washer 50 is put in the annular groove 24. The ear 22 is put between the ears 32. A bolt 34 is driven into the screw bore 31 through the countersink bore 33 and the apertures 23 and 51 in order to pivotally connect the first wrench 20 with the joint 30.

Figure 4:
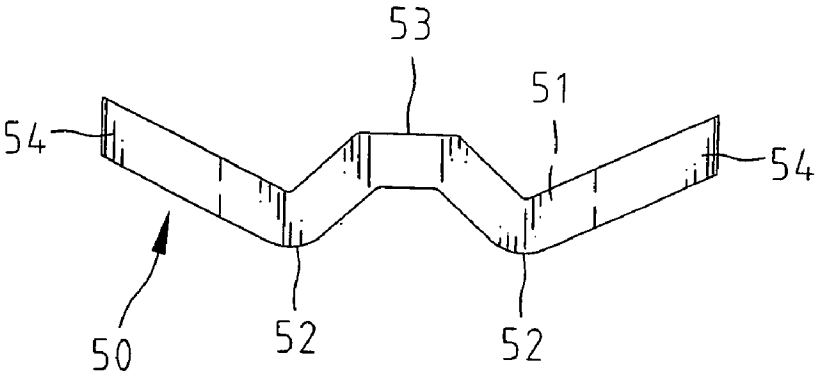
FIG. 4 is a side view of the washer of FIG. 3.
Figure 3:
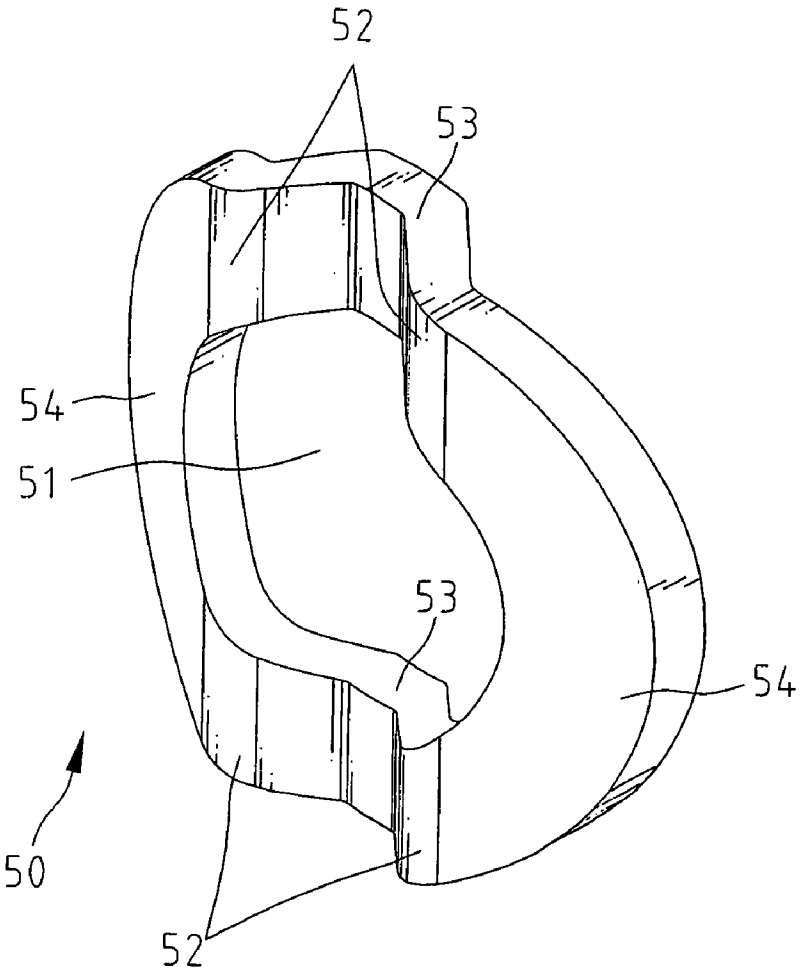
FIG. 3 is a perspective view of a washer shown in FIG. 2.

Referring to FIGS. 3 and 4, the washer 50 is made via pressing. The washer 50 includes a W-shaped configuration. The washer 50 includes a first side and a second side. Two pairs of contact locations 52 are formed at opposite positions of the aperture 51 on the first side of the washer 50. A central contact location 53 intermediate each pair of contact locations 52 and two lateral contact locations 54 are formed on the second side of the washer 50, with the central contact locations 53 located intermediate the two lateral contact locations 54. Each central contact location 53 is substantially a flat portion. The lateral contact locations 54 are higher than the central contact locations 53.

Referring to FIGS. 5 and 6, the washer 50 is compressed. The contact locations 53 and 54 abut the ear 22. The contact locations 52 abut one of the ears 32. The washer 50 is not damaged because the contact locations 54 take forces first. Thus, the joint 30 will not oscillate relative to the first wrench 20 in use.

Figure 7:
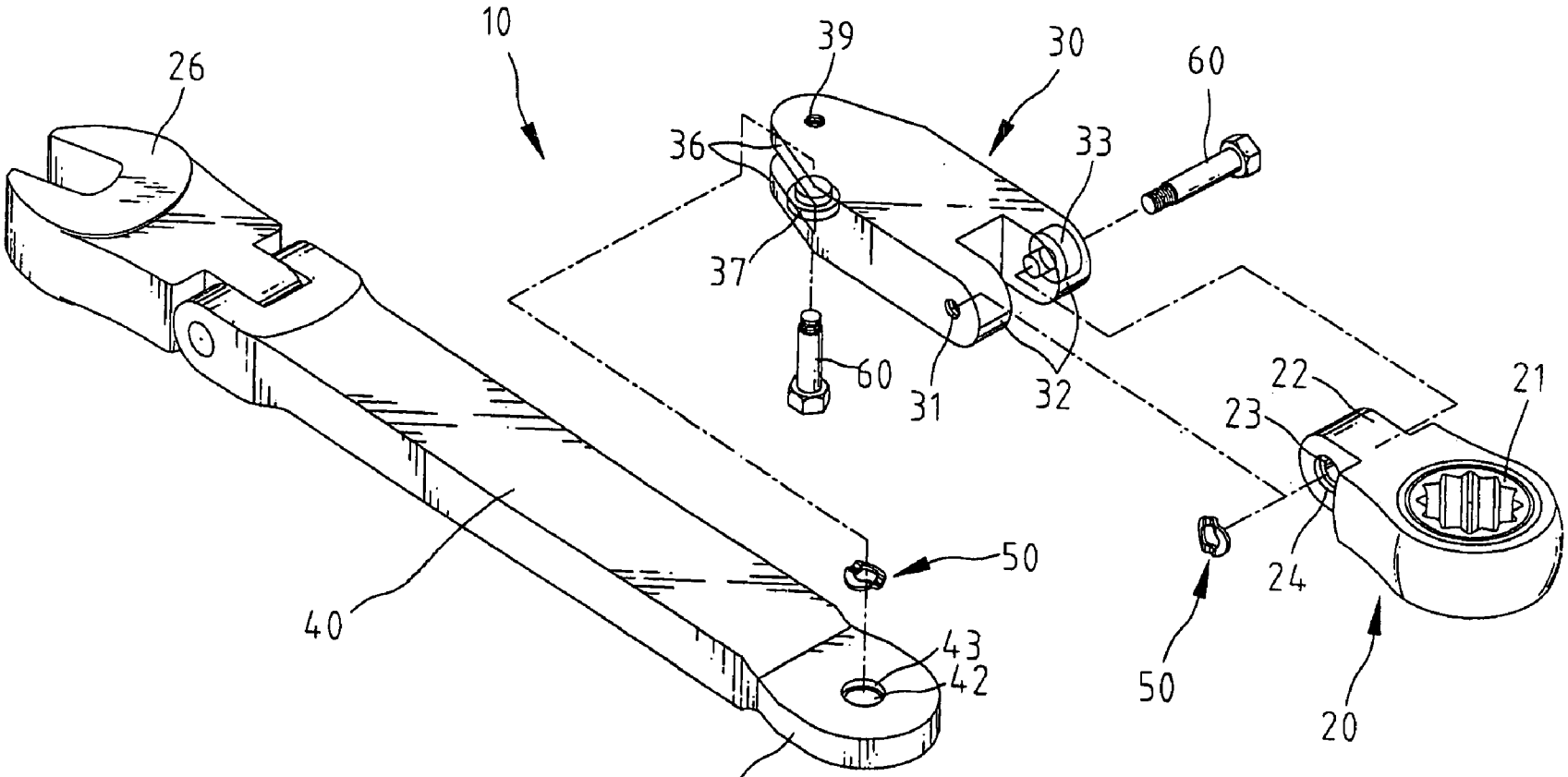
FIG. 7 is an exploded view of a wrench combination according to a second embodiment of the present invention.

FIG. 7 shows a wrench combination according to a second embodiment of the present invention. The second embodiment is identical to the first embodiment except for including bolts 60 with hexagonal heads instead of the bolts 34 and 38 with round heads.

Figure 8:
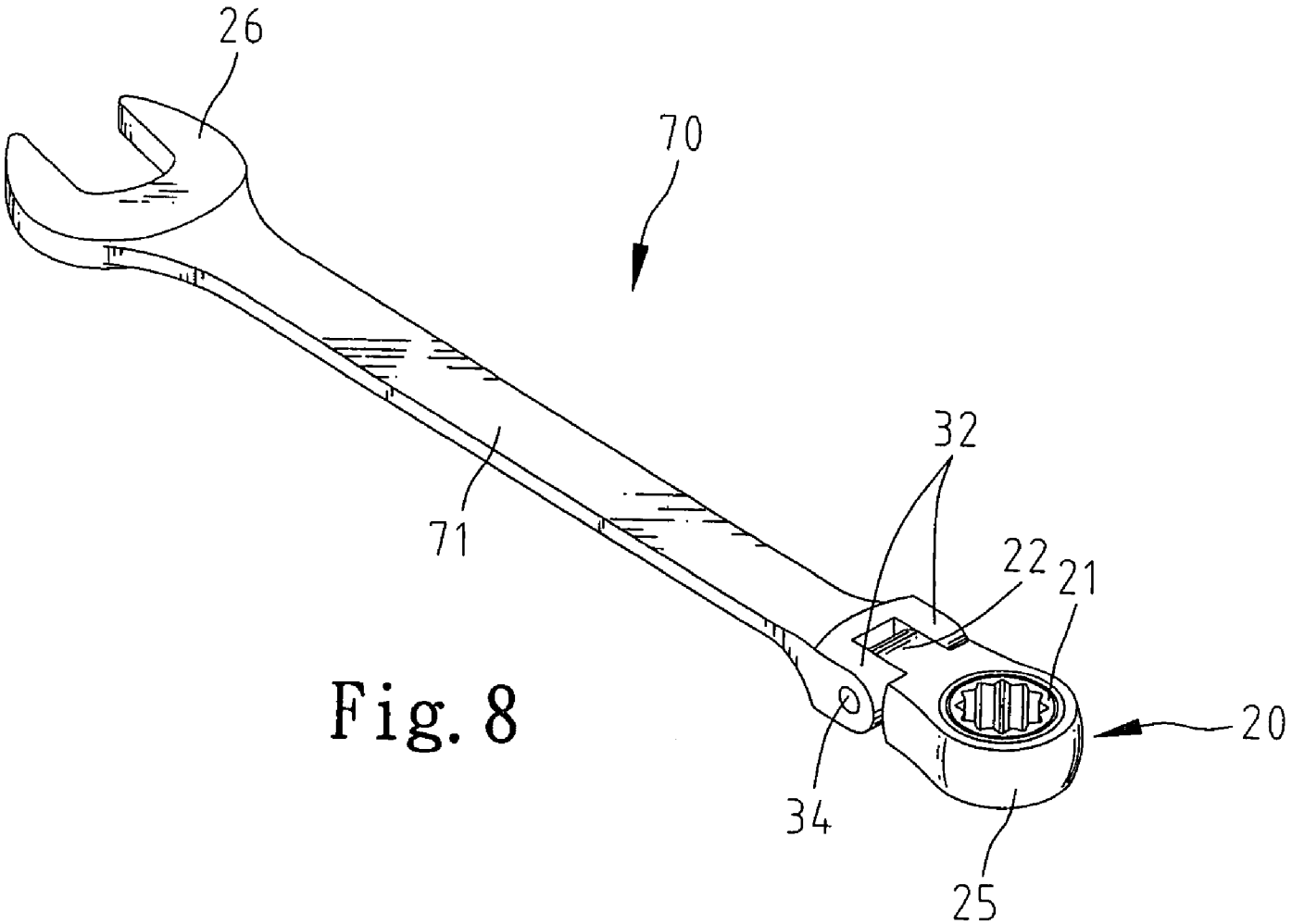
FIG. 8 is a perspective view of a wrench combination according to a third embodiment of the present invention.
Figure 9:
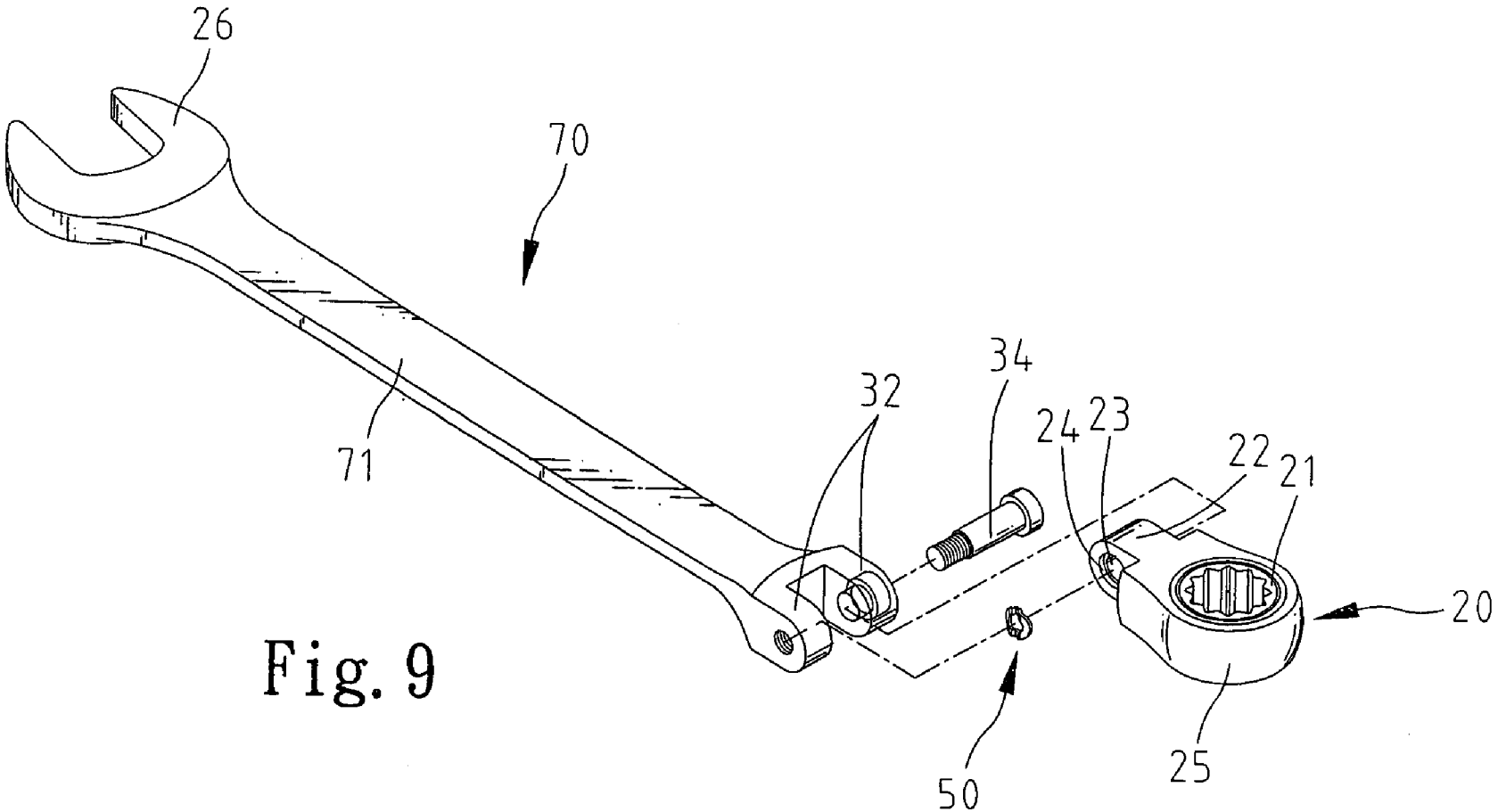
FIG. 9 is an exploded view of the wrench combination show in FIG. 8.
Figure 10:
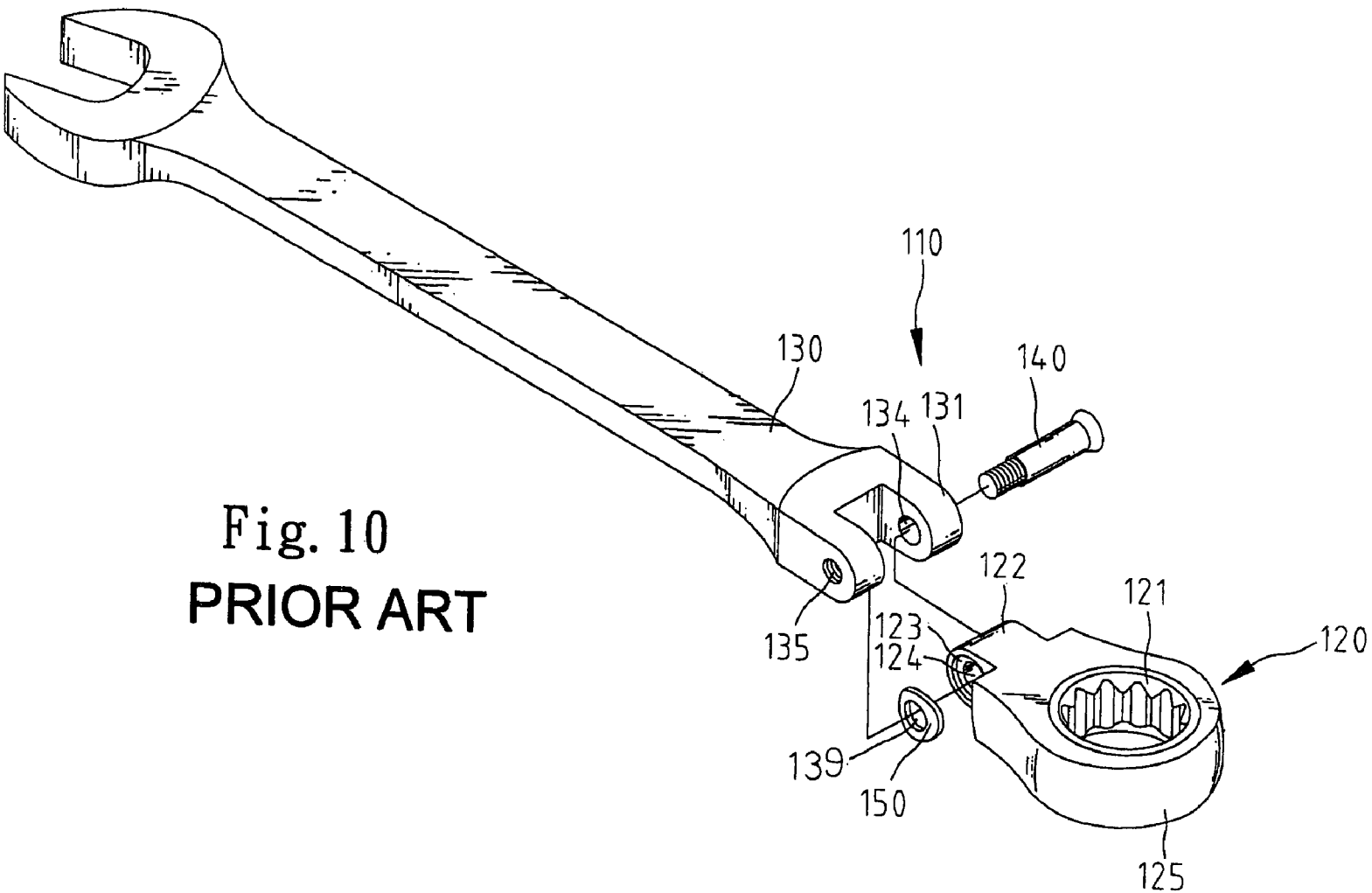
Fig. 10 PRIOR ART
FIG. 10 is an exploded view of a conventional wrench combination.
Figure 11:
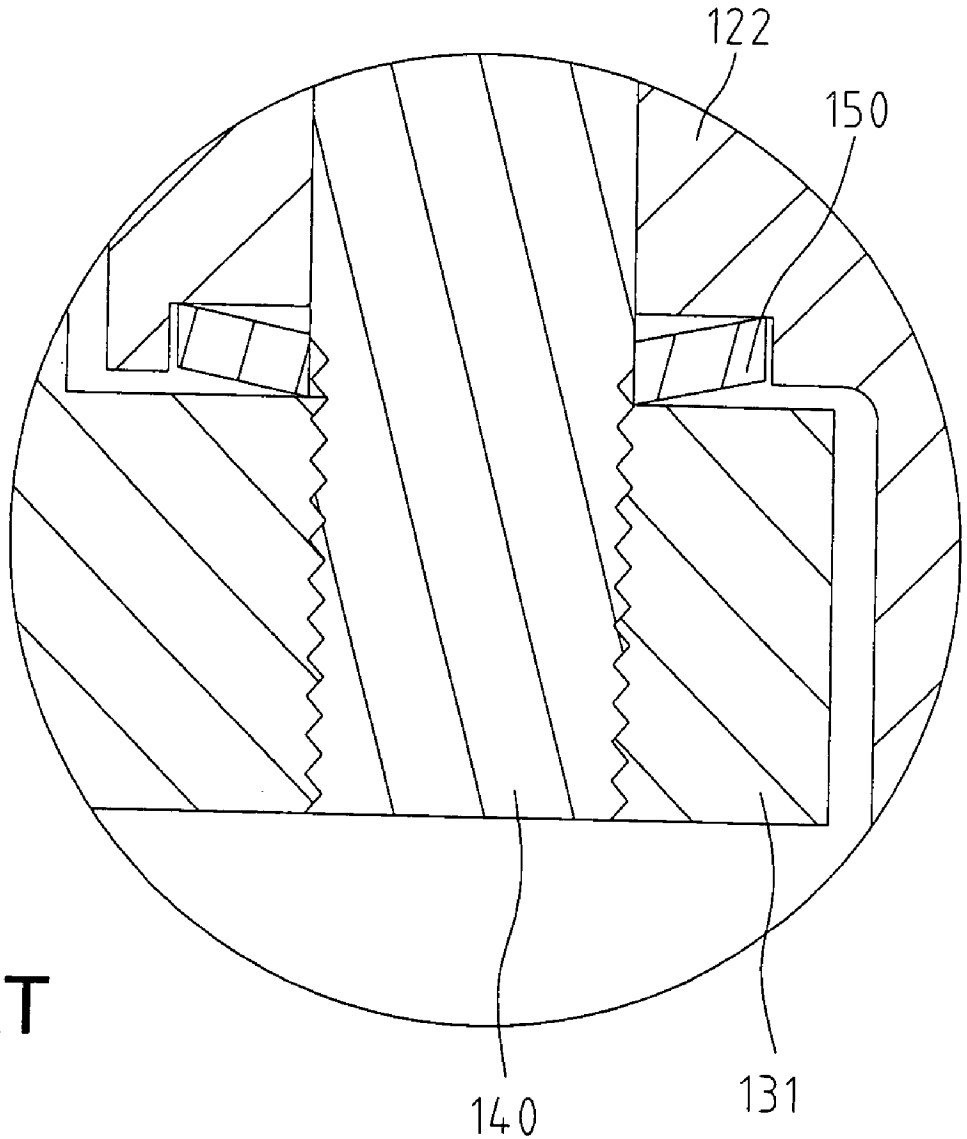
Fig. 11 PRIOR ART
FIG. 11 is a side view of the conventional washer shown in FIG. 10.

FIGS. 8 and 9 show a wrench combination 70 according to a third embodiment of the present invention. The third embodiment is identical to the first embodiment except for several things. Firstly, the joint 30 is eliminated. Secondly, the wrench combination 70 includes a handle 71 formed with two ears 32. Thirdly, the second wrench 26 is merged with the handle 71 instead of pivotally connected with the handle 40.

The present invention has been described through detailed illustration of the embodiments. Those skilled in the art can derive variation from the embodiments without departing from the scope of the present invention. Therefore, the embodiments shall not limit the scope of the present invention defined in the claims.

The invention claimed is:

1. A wrench combination comprising:

a handle comprising an ear formed at an end, with the ear of the handle comprising an aperture defined therein and an annular groove defined therein around the aperture;

a wrench comprising an annular head, an ear extending from the annular head and an annular gear put rotationally in the annular head, with the ear of the wrench comprising an aperture defined therein and an annular groove defined therein around the aperture;

a first washer put in the annular groove defined in the ear of the handle, the first washer comprising an aperture, first and second pairs of contact locations at opposite positions of the aperture on a first side and a central contact location intermediate each pair of contact locations and two lateral contact locations on an opposite second side, with the central contact locations located intermediate the two lateral contact locations;

a second washer put in the annular groove defined in the ear of the wrench, the second washer comprising an aperture, first and second pairs of contact locations at opposite positions of the aperture on a first side and a central contact location intermediate each pair of contact locations and two lateral contact locations on an opposite second side, with the central contact locations located intermediate the two lateral contact locations;

a joint comprising a first pair of ears for sandwiching the ear of the handle and a second pair of ears for sandwiching the ear of the wrench;

a first bolt driven in the first pair of ears of the joint, the aperture of the first washer and the ear of the handle; and a second bolt driven in the second pair of ears of the joint, the aperture of the second washer and the ear of the wrench.

2. The wrench combination according to claim 1 wherein the washers are made via pressing.

3. The wrench combination according to claim 1 wherein each central contact location is lower than the lateral contact locations when the washer is not compressed.

4. The wrench combination according to claim 3 wherein each central contact location is a flat surface.

5. The wrench combination according to claim 1 wherein each of the washers includes a W-shaped configuration in a side view.

6. The wrench combination according to claim 1 where each of the bolts includes a round head.

7. The wrench combination according to claim 1 wherein each of the bolts includes a hexagonal head.

8. The wrench combination according to claim 1 comprising an additional wrench pivotally connected with the handle.

9. The wrench combination according to claim 1 comprising an additional wrench merged with the handle.

10. A wrench combination comprising:

a handle comprising two ears formed at an end;

a wrench comprising an annular head, an ear extending from the annular head and an annular gear put rotationally in the annular head, with the ear of the wrench comprising an aperture defined therein and an annular groove defined therein around the aperture;

a washer put in the annular groove defined in the ear of the wrench, the washer comprising an aperture, first and second pairs of contact locations at opposite positions of the aperture on a first side and a central contact location intermediate each pair of contact locations and two lateral locations on an opposite second side, with the central contact locations located intermediate the two lateral contact locations; and a bolt driven in the ears of the handle, the aperture of the washer and the ear of the wrench, wherein each central contact location is lower than the lateral contact locations when the washer is not compressed, and wherein each central contact location is a flat surface.

11. The wrench combination according to claim 10 wherein the washer is made via pressing.

12. The wrench combination according to claim 10 wherein the washer includes a W-shaped configuration in a side view.

13. A wrench combination comprising:

a handle comprising two ears formed at an end;

a wrench comprising an annular head, an ear extending from the annular head and an annular gear put rotationally in the annular head, with the ear of the wrench comprising an aperture defined therein and an annular groove defined therein around the aperture;

a washer put in the annular groove defined in the ear of the wrench, the washer comprising an aperture, first and second pairs of contact locations at opposite positions of the aperture on a first side and a central contact location intermediate each pair of contact locations and two lateral contact locations on an opposite second side, with the central contact locations located intermediate the two lateral contact locations; and a bolt driven in the ears of the handle, the aperture of the washer and the ear of the wrench, wherein each central contact location is a flat surface.

14. The wrench combination according to claim 13 wherein the washer includes a W-shaped configuration in a side view.

15. The wrench combination according to claim 13 where the bolt includes a round head.

16. The wrench combination according to claim 13 wherein the bolt includes a hexagonal head.

17. The wrench combination according to claim 13 comprising an additional wrench pivotally connected with the handle.

18. The wrench combination according to claim 13 comprising an additional wrench merged with the handle.

* * * * *